US005425453A

United States Patent [19]

Dirx

[11] Patent Number: 5,425,453

[45] Date of Patent: Jun. 20, 1995

[54] LIGHT TIGHT STORAGE CONTAINER

[75] Inventor: Lieven F. Dirx, Oud-Turnhout, Belgium

[73] Assignee: Agfa-Gevaert N. V., Mortsel, Belgium

[21] Appl. No.: 328,609

[22] Filed: Oct. 25, 1994

Related U.S. Application Data

[63] Continuation of Ser. No. 164,540, Dec. 10, 1993, abandoned.

[51] Int. Cl.[6] ..... B65D 85/30

[52] U.S. Cl. ..... 206/455; 220/354

[58] Field of Search ..... 206/454, 455, 456, 334; 220/354, 355; 354/275

[56] References Cited

U.S. PATENT DOCUMENTS

| | | | |
|---|---|---|---|
| 4,545,486 | 10/1985 | Bostic | 206/455 |
| 4,984,688 | 1/1991 | Mikulin | 206/455 |
| 4,991,717 | 2/1991 | May et al. | 206/455 |
| 5,085,758 | 2/1992 | Guadagno et al. | 206/454 X |
| 5,097,953 | 3/1992 | Gingras | 206/454 |
| 5,125,509 | 6/1992 | Takei et al. | 260/334 X |

*Primary Examiner*—Jacob K. Ackun
*Attorney, Agent, or Firm*—William J. Daniel

[57] ABSTRACT

A light tight storage container for photographic sheet material comprises a base having a floor and upstanding sidewalls constituting a tray for holding stack of the sheet material and a generally flat lid covering the top of the tray. The tray and lid respectively have outer peripheral margins bent angularly to the plane of the lid in mating relation to create a light tight labyrinth. At its outer termination, the outer peripheral margin of the tray is formed as an upwardly opening shallow channel while the outer termination of the lid is formed as a lip seating in the channel to act as a separable hinge along which the lid can pivot relatively to the tray to open the tray. The lid can also be completely removed. The channel is spaced above the plane of the tray floor for insertion of the fingers thereunder for lifting of the tray with or without the lid in place.

10 Claims, 2 Drawing Sheets

LIGHT TIGHT STORAGE CONTAINER

This application is a continuation of application Ser. No. 08/164,540, filed Dec. 10, 1993, now abandoned.

FIELD OF INVENTION

This invention relates to a light tight container for the storage of photographic materials particularly light sensitive sheet materials.

BACKGROUND OF INVENTION

Conventionally photographic sheet material has been transported in cardboard boxes in which it is always stored in a dark room. These boxes are light tight and are made of high quality cardboard materials and are therefore expensive. These boxes are not adapted to be recycled. Furthermore since the same box is used for transport and dark room storage there is a danger that fibres of cardboard may be worn from the inside of the box and contaminate the photographic material.

It is therefore desirable when handling photographic sheet material to separate the transport and storage functions.

The photographic sheet can be placed into black plastic bags or wrapping and transported in a cheap cardboard. Once in a dark room the sheet material is removed from its transport box and wrapper, and placed into a storage container. Since the dark room storage function is now separated from the transport function there is less danger of contamination of the sheet material by the transport box.

The present invention provides an improved light tight storage container for photographic material.

STATEMENTS OF INVENTION

According to the invention there is provided a light tight storage container for photographic material comprising a base having an outer peripheral margin including an outer edge portion; a lid cooperating with the base to form a light tight receptacle and having an outer peripheral margin engagable with the base outer margin to form a light labyrinth, and an outer edge portion engagable with the base edge portion to form a pivot, the lid being separable from the base by lifting to cause complete separation therebetween, and by pivoting the lid relative to the base around said interengaged edge portions.

Preferably the base outer edge portion comprises a groove or channel extending around at least a portion of the base outer peripheral margin, and the lid outer edge portion is a lip extending around at least a portion of the lid outer peripheral margin and which is engagable in the groove.

The container may be rectangular with a rectangular base and lid, the groove extending around the entire peripheral margin of the base, and the lip extending around the entire peripheral margin of the lid, thereby allowing for pivotal movement of the lid about any one of the four sides of the lid.

The container is preferably made from plastic sheet with both the lid and base being formed from high impact polystyrene or ABS (Acrylonitrile Styrene Butadiene) sheet using vacuum forming techniques.

Also according to the invention there is provided a light tight rectangular storage container for photographic material comprising a lid, and a rectangular base having a substantially flat floor surrounded by a raised boss forming a rectangular cavity for storage by photographic sheets, the raised boss having four internal corners and portions of the internal walls of the boss adjacent the corners are recessed on their inner surfaces to give access to corner edges of rectangular photographic sheet extending fully between the inner walls of the cavity.

Yet another aspect of the invention provides a light tight storage container for photographic material comprising a base having a substantially flat floor surrounded by a raised hollow boss forming a cavity for storage of photographic material the boss of inverted generally U-shaped cross-section having a downwardly extending outer wall, i.e. outer leg of the inverted U, which terminates above the floor of the cavity, and a lid having an outer peripheral recess which receives the boss to form a light labyrinth, the hollow within the boss i.e. inside the inverted U, being accessible from below to form handles for lifting the one container.

DESCRIPTION OF DRAWINGS

The invention will be described by way of example and with reference to the attached following drawings in which.

DETAILED DESCRIPTION OF INVENTION

Figure 1:
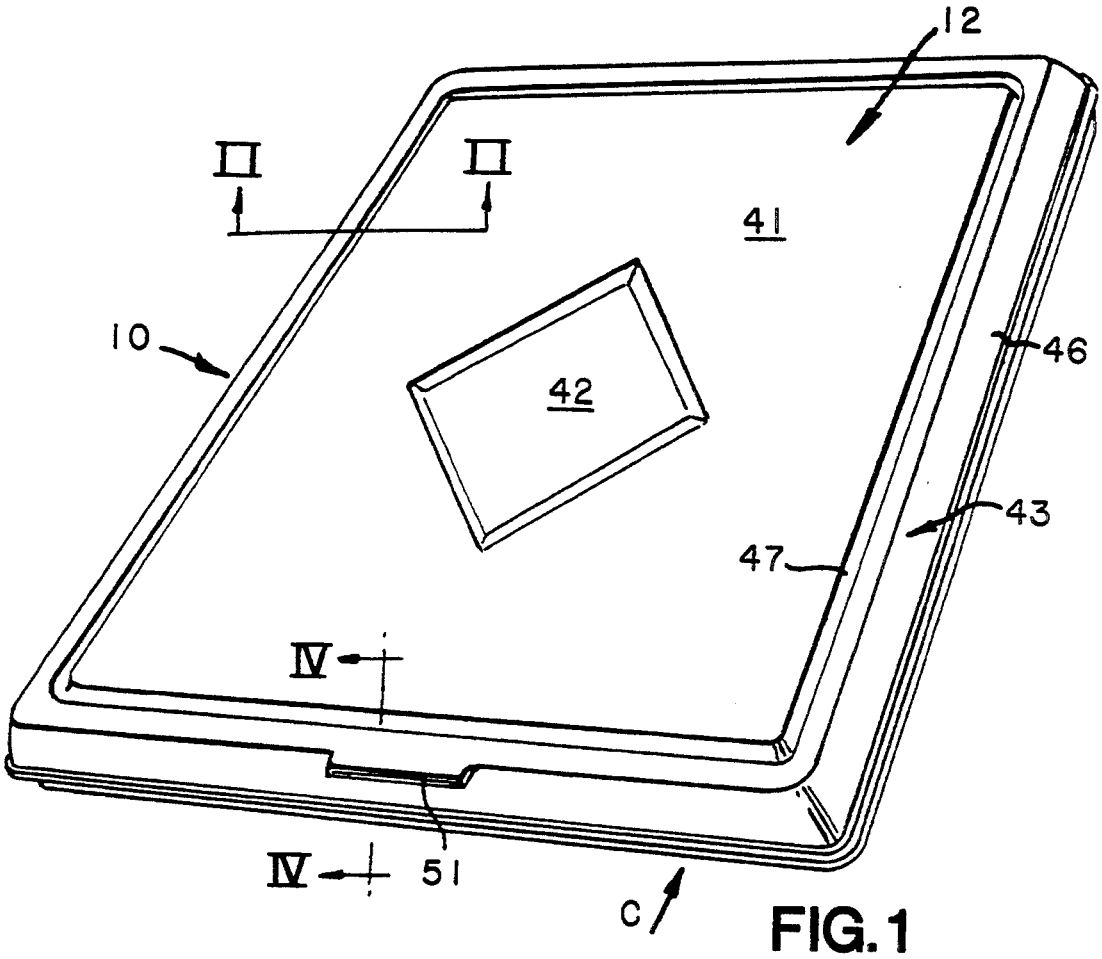
FIG. 1 is a perspective view of a storage container according to the invention in a closed condition.
Figure 2:
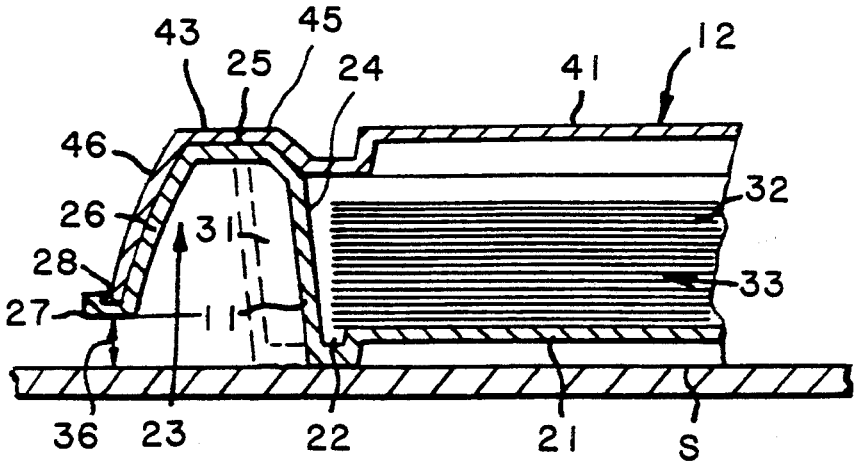
FIG. 2 is a section on the line II—II of FIG. 1, showing the container standing on a surface.
Figure 3:
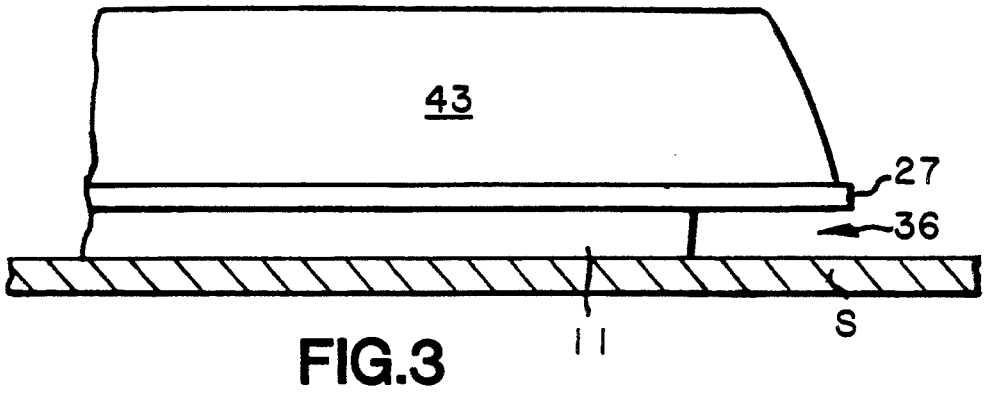
FIG. 3 is an elevational view of the corner of the container taken in the direction of arrow C, also showing the container on a surface.
Figure 4:
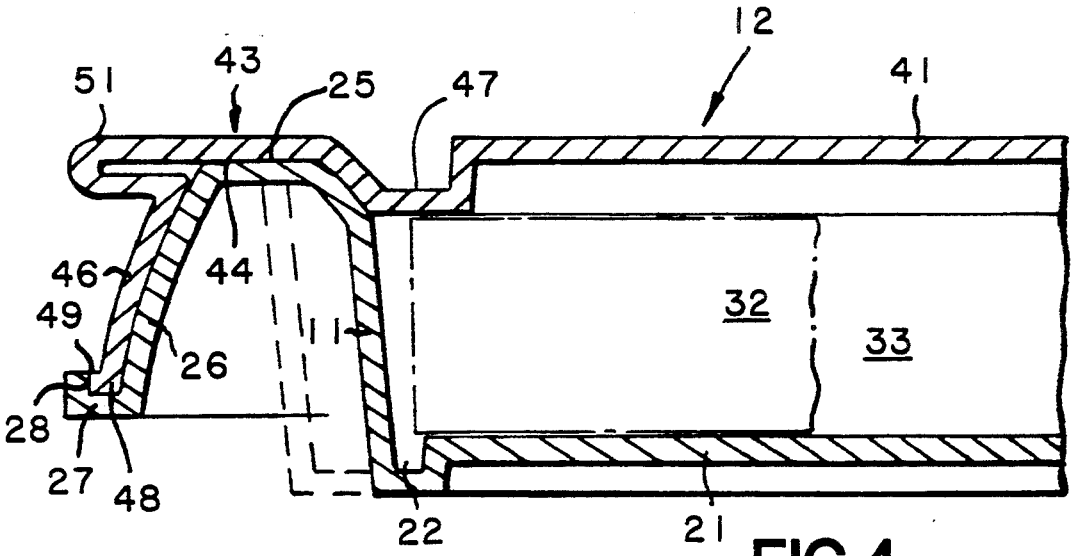
FIG. 4 is a section on the line IV—IV of FIG. 1 showing the handle.
Figure 5:
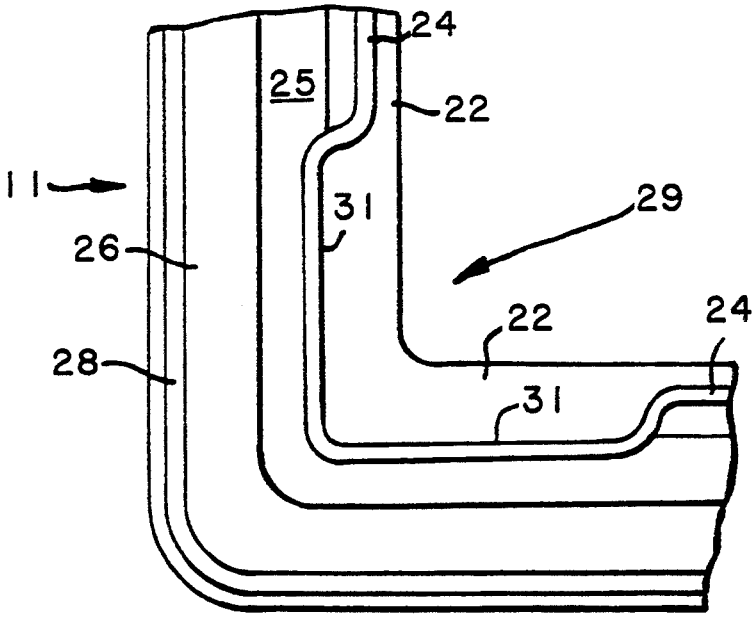
FIG. 5 is a plan view of the corner of the base from above showing the recesses.

The invention as illustrated in FIGS. 1–5 provides a light tight container 10 for the storage of photosensitive sheet materials in a dark room. Such containers are sometimes referred to as dark room paper safes.

The container 10 is a two part container comprising a base 11 and a lid 12 which are completely separable from each other by lifting the lid upwardly away from the base.

The container as shown is rectangular in shape (the term rectangle including a square) and may be of such size to accept the largest commercially available size of photographic plate or sheet material. This sheet material may comprise a paper, a polyester, an aluminium, or like support.

The base 11 and lid 12 are preferably manufactured from black plastic sheet material using vacuum forming techniques. Suitable materials are high impact polystyrene and ABS, but other plastics material may be suitable, as may other sheet materials that do not transmit light.

The base 11 comprises a substantially flat floor 21 and is surrounded by a gutter 22. The gutter 22 serves to raise the floor above the level of any surface 'S' on which the container 10 is placed. The outer peripheral margin 23 of the base is formed as a raised hollow boss 23 of inverted generally U-shaped cross section which extends continuously around the floor 21 from which it is spaced laterally by the gutter 22.

The raised hollow boss 23 comprises a tapering inner wall 24, a flat upper surface 25, and a downwardly extending arcuate outer wall 26. The outer wall 26 terminates above the floor 21 of the container so that there is a gap 36 between the lower edge of the outer wall 26 and the surface 'S' on which the container rests. The gap 36 allows fingers to be placed under the lower edge into the hollow boss for lifting.

The outer wall 26 has an outer peripheral edge portion 27 comprising upwardly opening groove or channel 28 which extends around the entire peripheral margin of the base 11.

The rectangular base 11 has four internal corners 29 and the inner walls 24 adjacent the corners are recessed adjacent the corners, the recesses 31 opening into the gutter 22.

When a stack of photographic sheet material 32 is located in the cavity 33 formed from the raised boss 23 and the floor 21, the recesses 31 allow access to the corner edges of the sheet material for lifting of the material out of the cavity 33. Furthermore, the recesses (31) avoid contact of the corners of the sheet with the base walls (24) and prevent thereby damage to the corners by inadvertent handling of the container (10).

The lid 12 cooperates with the base 11 to form a light tight receptacle for the photographic material 32. The lid 12 has a substantially flat central portion 41 which may have at least one depression 42 therein for strengthening purposes. The central portion 41 is surrounded by an outer peripheral margin 43 which is engagable with the outer margin 23 of the base to form a light labyrinth so that the cavity 33 is completely dark when the lid is fully engaged with the base. The lid outer peripheral margin 43 comprises a downwardly facing recess 44 comprising a flat base 45 having on its outer side a downwardly projecting arcuate sidewall 46 and on its inner side a downwardly projecting rib 47 defining an upwardly opening corresponding groove on its upper side.

The downwardly facing inner surfaces of the recess 44 are shaped to match and engage the upwardly facing surfaces of the raised boss 23 to form a light labyrinth.

The downwardly extending outer sidewall 46 terminates in an outer edge portion 48 which may have a lip 49 which extends around the entire peripheral margin of the lid 12. The lip 49 is engagable in the groove 28 around the entire periphery of the container 10, so that the lip 49 engaging in the groove 28 can form a hinge for the pivoting movement of the lid relative to the base.

The lid 12 can pivot along any one of its four sides.

The lid 12 along one of its sides has a central handle 51 integrally formed therein adjacent the base 45 of the recess 44. The handle 51 aids the lifting of one side of the lid 11 which pivots about its opposite side where its lip 49 engages in the groove 28 in the base. By having the handle 51 adjacent the base 45 the integrity of the light labyrinth is ensured and retained in the region of the handle 51.

Alternatively, the lid 11 can be removed completely from the base 12 by lifting upwardly (with some difficulty due to the arcuate outer sidewall 46).

The container 10 can be moved as a unit by placing the fingers through the gap 36 into the hollow underside the boss 23. This automatically brings the thumbs onto the upper surface of the base 45 of the recess to hold the lid in place, keeping the container light-tight.

What is claimed is:

1. A light tight storage container for a stack of photographic material comprising a generally rectangular base having an interior floor surrounded on four sides by sidewalls generally upstanding from peripheral edges of said floor to define a tray for holding said stack of material, and extending from an upper end of each of said sidewalls an outer peripheral margin including a flange projecting laterally from the sidewall upper end and a skirt extending generally downwardly from an outer edge of said flange at an angle inclined from the plane of said sidewall, said skirt carrying on its lower edge along at least a portion of at least one side of said tray an upwardly opening shallow channel having its open upper end separated vertically from said flange by said skirt; and a generally rectangular unitary lid substantially coextensive with said base and fitting over the top of said tray to close the same in light tight fashion, said lid having an outer peripheral margin including a lateral flange and an downwardly angularly extending skirt generally parallel to and in generally mating engagement with the laterally projecting flange and angularly extending skirt of said tray to form therewith a light-blocking labyrinth, the skirt of said lid terminating along at least a portion of at least one side thereof in an edge fitting in said shallow channel to be carried by said tray skirt and engaged in said channel when said lid is tilted to raise a side thereof opposite to said portion of said one side to form a pivot axis, about which axis the lid can be pivoted bodily to open the tray, said lid being completely separable from the tray by lifting the lid bodily vertically away from the tray.

2. A container as claimed in claim 1, wherein said shallow channel extends around the entire periphery of the tray skirt, and the terminal edge of said lid skirt extends around the entire periphery of the lid skirt, allowing for pivotal movement of the lid about any of the four sides of the tray.

3. A container as claimed in claim 2, wherein the outer peripheral margin of said tray together with the adjacent upstanding side wall have an inverted generally U-shaped cross-section to thereby form a downwardly opening cavity, and the outer peripheral margin of said lid is of inverted generally L-shaped cross-section and substantially mates with an outer leg and base of the U-shaped cross-section of the margin of said tray to form the light labyrinth.

4. A container as claimed in claim 3, wherein the floor of the tray includes a substantially flat main portion and surrounding said main portion and adjacent a lower end of said upstanding sidewalls an upwardly opening gutter having an open upper end level with said flat main portion of said floor.

5. A container as claimed in claim 3, wherein the sidewalls of said tray adjacent the four internal corners thereof are recessed outwardly of the tray.

6. A container as claimed in claim 4, wherein the recesses in the sidewalls of said tray extend downwardly below the level of said main portion of the floor of the tray and communicate with the gutter to enlarge said gutter adjacent the corners of said tray.

7. A container as claimed in claim 3, wherein the inverted generally U-shaped cross-section of said sidewalls and outer peripheral margins of said tray includes an upwardly and outwardly inclined flat extending between the upper end of said sidewalls and the base of the U shaped cross-section and the end of the base of said inverted L-shaped cross-section has a correspondingly inclined extension mating with said flat to form a part of the light labyrinth.

8. The container of claim 1, wherein the channel at the termination of said outer peripheral margins of said base is spaced above the floor of the tray to allow access for fingers so that the tray can be lifted by inserting fingers in the space below said channel.

9. The container of claim 1, wherein an integral handle is formed on one side of said outer peripheral margin of said lid for pivoting the lid, the handle projecting outwardly of said lid.

10. A container as claimed in claim 1, wherein the edge terminating the skirt of said lid and fitting in said shallow channel on the outer peripheral margin of said tray carries a laterally projecting bead received by said channel to reinforce said edge.

* * * * *